US005870862A

United States Patent [19]

Gordon

[11] Patent Number: 5,870,862

[45] Date of Patent: Feb. 16, 1999

[54] BURIAL VAULT

[76] Inventor: Graham Gordon, 74 Hawthorne Road, Orangeville, Ontario L9V 1A4, Canada

[21] Appl. No.: 745,257

[22] Filed: Nov. 8, 1996

[51] Int. Cl.[6] ..... E04H 13/00

[52] U.S. Cl. ..... 52/128; 52/105; 52/141; 27/7; 27/17; 27/35

[58] Field of Search ..... 52/128, 141, 105; 27/7, 17, 35; 220/23.8; 264/454, 535

[56] References Cited

U.S. PATENT DOCUMENTS

| | | | |
|---|---|---|---|
| 3,868,799 | 3/1975 | Hayward | 27/35 X |
| 4,237,590 | 12/1980 | Work | 27/35 |
| 4,253,220 | 3/1981 | Work | 27/35 |

*Primary Examiner*—Christopher Kent
*Attorney, Agent, or Firm*—Jack E. Dominik

[57] ABSTRACT

A hollow plastic burial vault having a base and a cover moulded as an integral unit and having a peripheral flange extending about the vault. The flange includes a first sealing surface portion, a first joint portion, a second sealing surface portion, and a second joint portion. The first sealing portion is formed to seat and seal against the second sealing surface, and the first joint portion is formed to join releasably with the second joint portion when the flange is severed along its length to separate the cover and the first sealing surface and joint portions from the base and the second sealing surface and joint portions. A method of manufacturing such a vault is also provided.

7 Claims, 6 Drawing Sheets

BURIAL VAULT

FIELD OF THE INVENTION

This invention relates to the construction of an improved burial vault.

BACKGROUND OF THE INVENTION

A burial vault is a container to hold a casket during burial and to protect and seal the casket from the environment. Historically, burial vaults were constructed of thick concrete walls with a concrete slab top. Westenhaver disclosed a plastic casket and burial vault in U.S. Pat. No. 2,508,319. Since that date various constructions of plastic burial vaults have been disclosed in prior art patents, including U.S. Pat. Nos. 2,806,278; 2,916,797; 3,208,186; 3,295,179; 3,581,452; 3,983,206; 4,154,031; 4,253,220; 4,288,952; 4,727,632; and 5,121,529. Typically, the problems that have been addressed in these patents concern the strength and the sealing of the vault. For example, U.S. Pat. No. 4,154,031, entitled "VAULT", teaches a construction having integral ribs or imbedded rods to enhance the rigidity of the vault and its load supporting strength during usage, while U.S. Pat. No. 3,983,206, entitled "SEALANT SYSTEM FOR BURIAL VAULT AND METHOD OF APPLICATION", discusses the importance of a good seal about the periphery of a burial vault.

U.S. Pat. No. 4,253,220, entitled "BURIAL VAULTS", is most similar in shape to the present invention. It discloses a burial vault including a base and a cover moulded from plastic resinous material. The base and the cover have reinforcing ribs formed integrally on the inner surfaces of the side and end walls. Further reinforcing ribs are formed on the bottom of the base and on the top inner surface of the cover. The outer surfaces of the cover and the base have geometrically shaped recesses to receive decorative panels. The cover and the base are sealed with tongue and groove sealing joints about their respective rims where they join.

It is an object of the present invention to provide an improved construction of a burial vault which enables the vault to be moulded in one operation, which simplifies the manufacture of the sealing joint and which provides a novel structure to provide strength and rigidity to the vault.

SUMMARY OF THE INVENTION

The present invention is a burial vault comprising a moulded plastic resinous base having a bottom wall, two side walls, and two end walls, and a moulded plastic resinous cover including a top wall, two side walls, and two end walls. The cover and base are moulded as an integral unit joined by a peripheral flange extending about the vault. Particularly, the flange includes a first sealing surface portion, a first joint portion, a second sealing surface portion, and a second joint portion. The first sealing portion is formed to seat and seal against the second sealing surface, and the first joint portion is formed to join releasably with the second joint portion when the flange is severed along its length to separate the cover and the first sealing surface and joint portions from the base and the second sealing surface and joint portions.

In the preferred embodiment of the burial vault of this invention, the cover and the base each have a plurality of reinforcing grooves having sidewalls of a depth sufficient to strengthen the top bottom and side walls of the base and the cover against predetermined loading of the vault during burial. Moreover, the burial vault of this invention features at least one of the cover and the base having one or more walls having grooves formed in one or more rectangles to reinforce the walls against bending under predetermined loading during burial.

In particular, the peripheral flange extending about the vault between the cover and the base and includes a first sealing surface U-shaped portion, a first joint inverted U-shaped portion, a second joint upward extending portion, and a second horizontal sealing surface portion. The first sealing U-shaped portion is formed to seat and seal against the horizontal sealing surface portion, and the first joint inverted U-shaped portion is formed to receive in a releasable connection the second joint upward extending portion to restrict lateral movement when the flange is severed along Its length to separate the cover and the first sealing U-shaped surface and inverted U-shaped joint portions from the base and the upward extending joint portion and the second horizontal sealing surface portion.

This invention also relates to a method of manufacturing a hollow plastic burial vault comprising a base having a bottom wall, two side walls, and two end walls, and a cover having a top wall, two side walls, and two end walls, comprising the steps of:

a) moulding the cover and base as an integral unit joined by a peripheral flange extending about the vault, and the flange including a first sealing surface portion, a first joint portion, a second sealing surface portion, and a second joint portion; the first sealing portion being formed to seat and seal against the second sealing surface and the first joint portion being formed to join releasably with the second joint portion when the flange is severed along its length to separate, and b) severing the flange to separate the cover and the first sealing surface and joint portions from the base and the second sealing surface and joint portions.

DESCRIPTION OF THE FIGURES

In the figures which illustrate a preferred embodiment of this invention.

DESCRIPTION OF THE INVENTION

Figure 1:
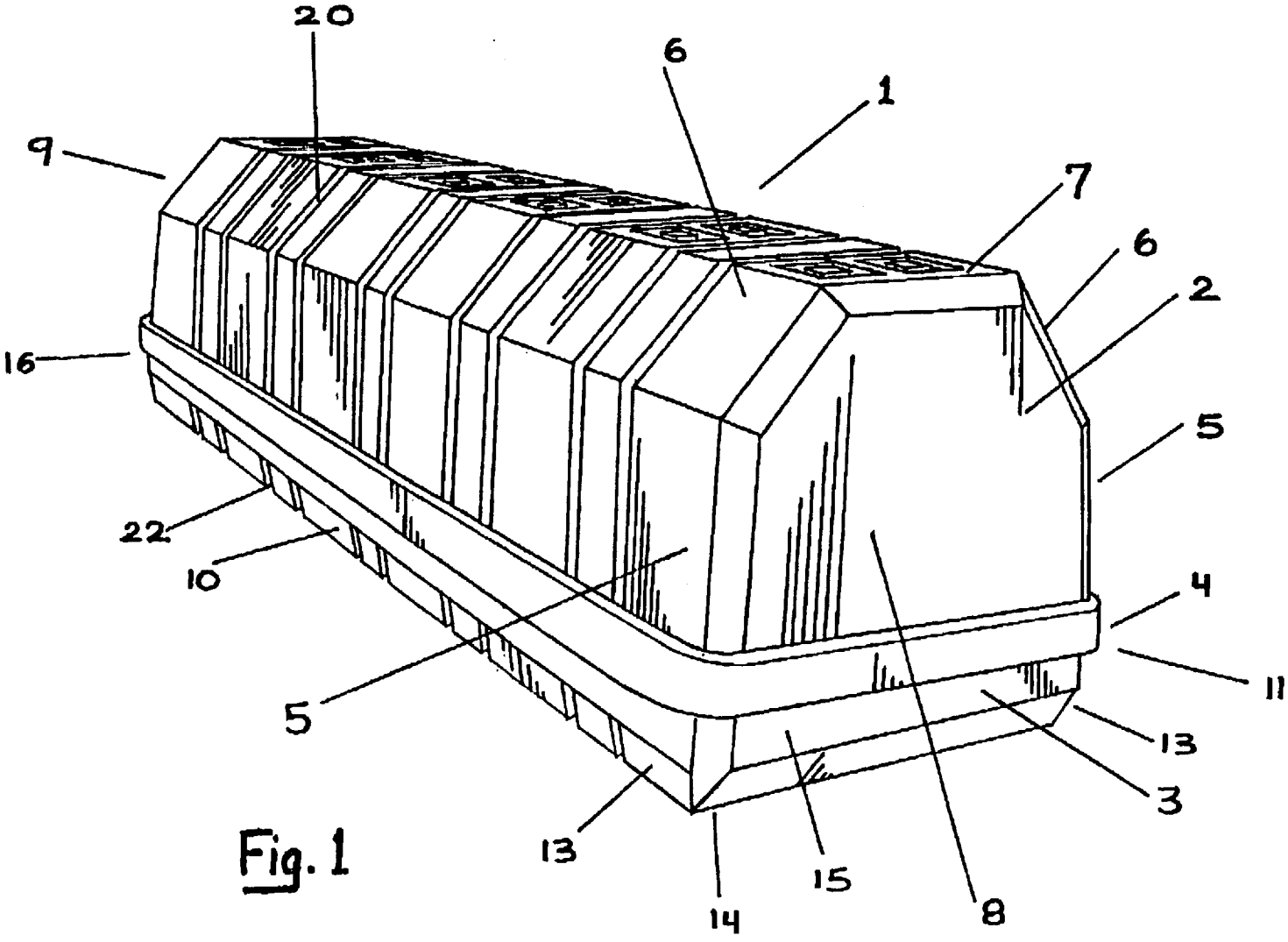
FIG. 1 is a perspective view of a burial vault.
Figure 2:
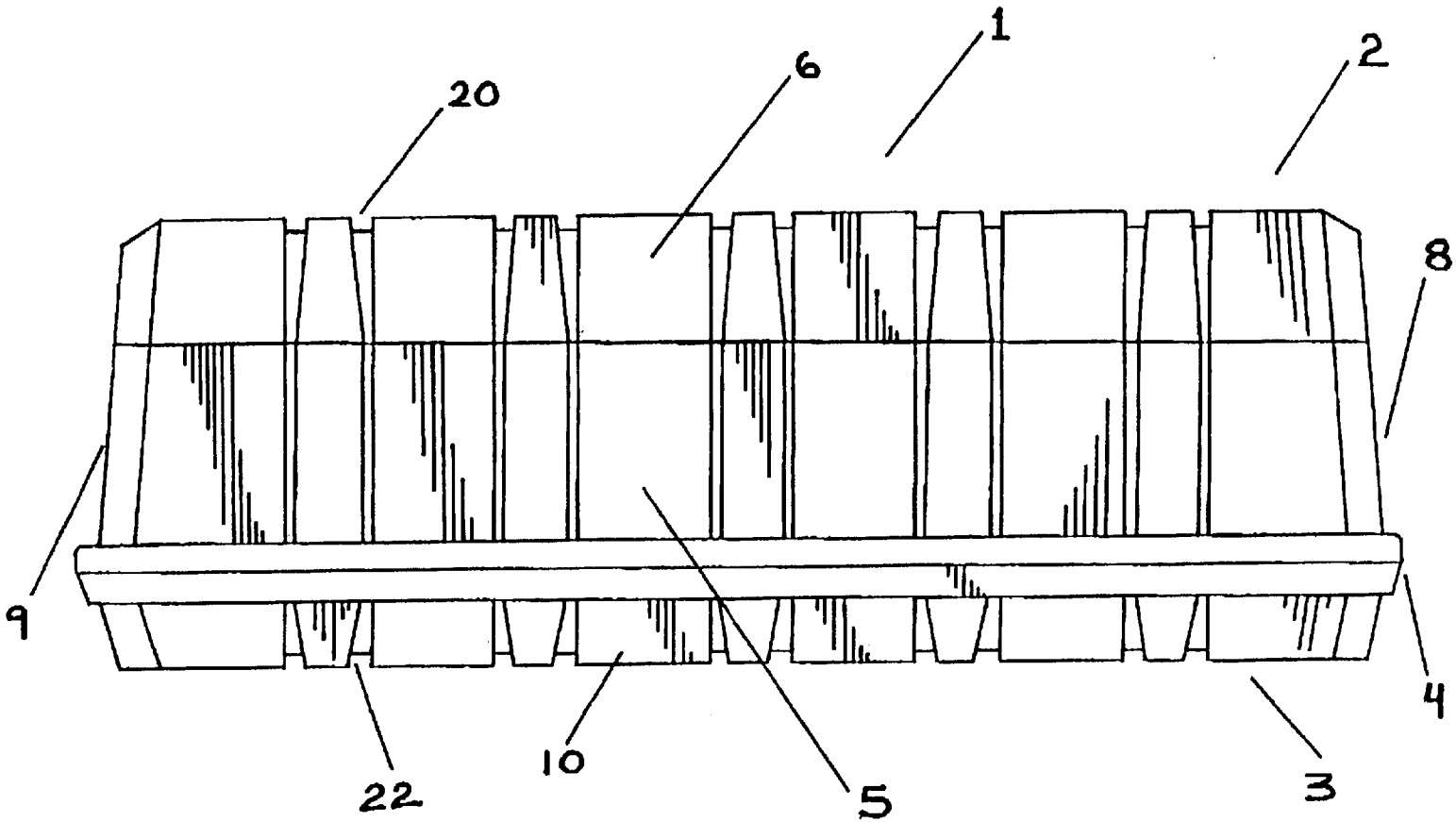
FIG. 2 is a side view of the burial vault.
Figure 4:
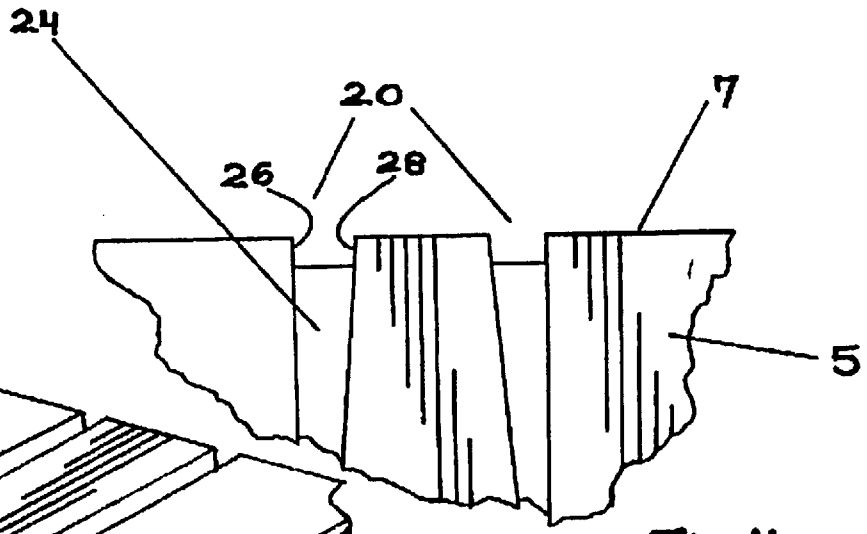
FIG. 4 is a side view of a broken away portion of the top cover illustrating the reinforcing grooves.
Figure 3:
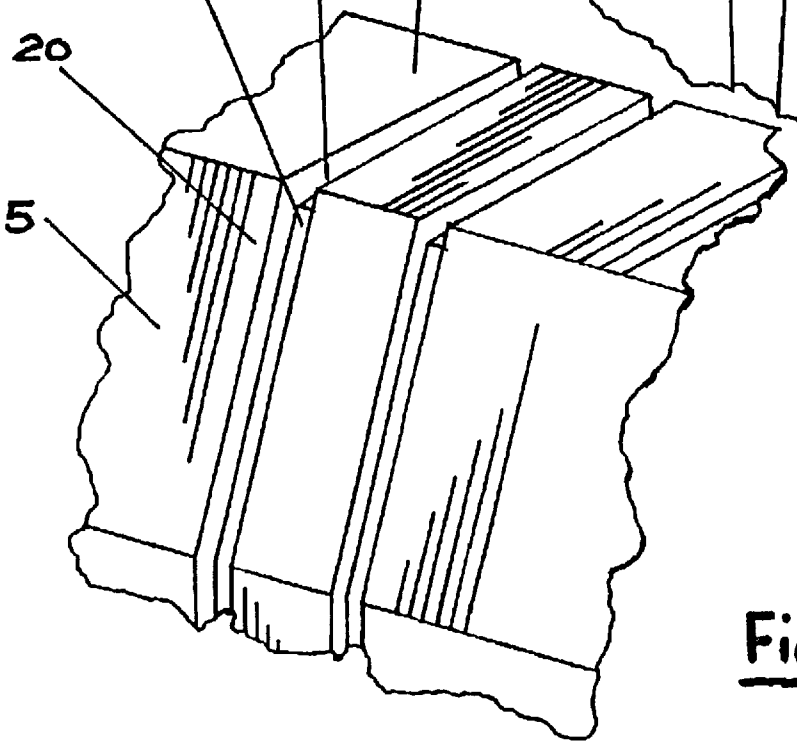
FIG. 3 is a perspective view of a broken away portion of the top cover illustrating the reinforcing grooves.

FIG. 1 illustrates a hollow burial vault 1 having a top cover 2, a base 3, and a sealing section 4 about the periphery where the cover meets the base. The burial vault 1 is appropriately sized to contain a casket (not shown). The cover 2 is formed with two side walls 5 extending upwardly from the sealing section 4 that turn inwardly at an angle of approximately 45° to become two slanted side walls 6 that are topped by a top wall 7. Two end walls 8 and 9 extend upwardly from the sealing section 4, but are chamfered inwardly where they meet the side walls 5, the slanted walls 6 and the top wall 7. The base 3 has side walls 10 depending downwardly and inwardly from the sealing section 4 to a bottom wall 14. End walls 15 and 16 depend downwardly from the sealing section 4 and are chamfered to meet the side walls 10 and the bottom wall 14. A plurality of reinforcing grooves 20 are formed in the cover 2 along the side walls 5, the slanting walls 6 and the upper wall 7. Corresponding reinforcing grooves 22 are formed in the base 3 along the side walls 10 and the bottom walls 14.

FIGS. 2, 3, 4, and 5, illustrate typical reinforcing grooves 20 of the cover 2. Each groove 20 extends up, over and down the cover 2 from a first position on the sealing section 4 on one side of the cover 2 to a corresponding, but opposite, second position of sealing section 4 on the other side of the cover 2. Each groove 20 has a bottom 24 and two side walls 26 and 28. The depth of the side walls 26 and 28 is pre-determined to displace the groove bottom 24 from the side walls 5 and the top wall 7 of the burial vault to resist bending and to provide sufficient strength for the anticipated loads on the vault. The reinforcing grooves 22 of the base 3 are similarly constructed to resist bending.

Figure 5:
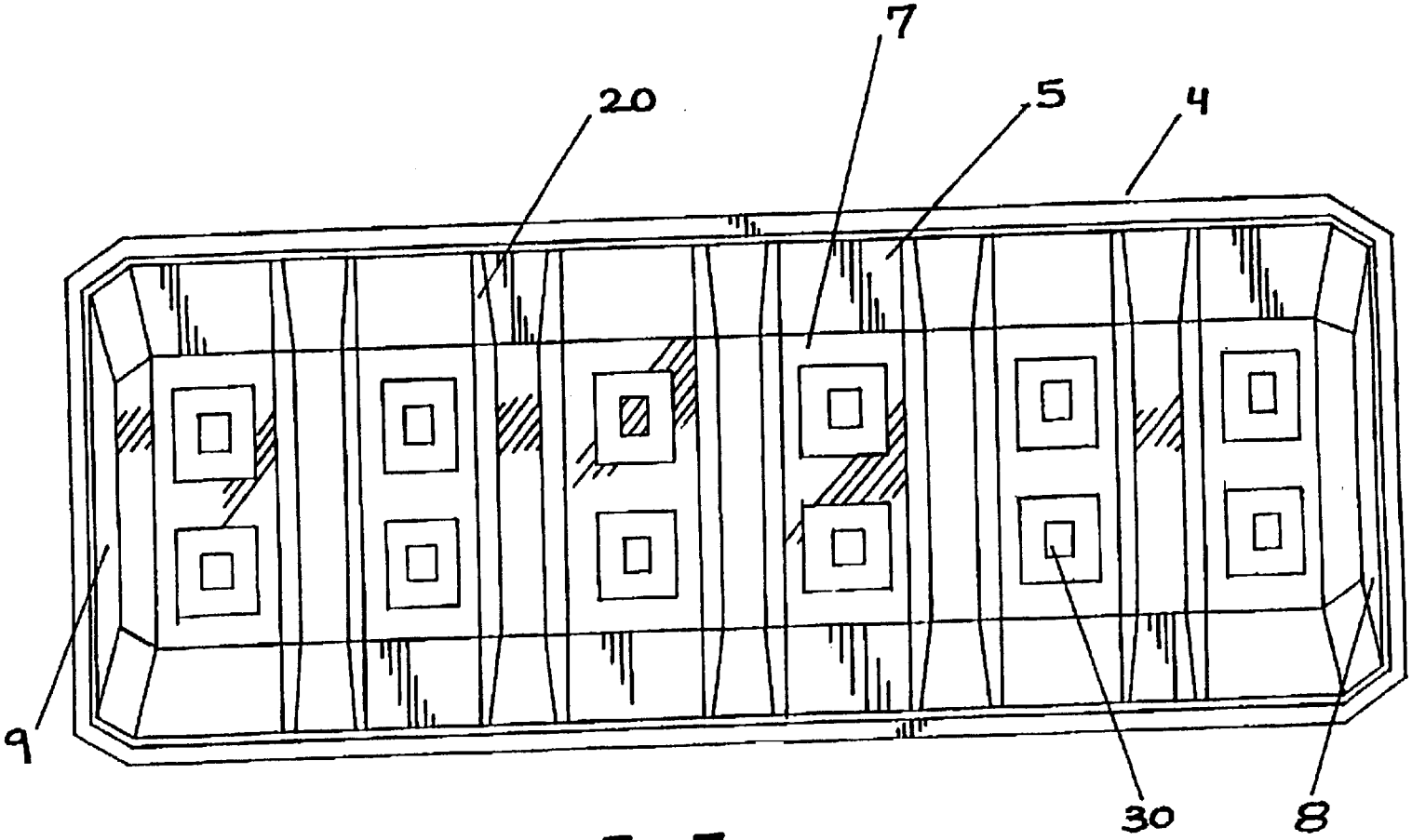
FIG. 5 is a top view of the cover.

FIG. 5 also illustrates rectangular reinforcing grooves 30 formed at regular intervals in the top wall 7 of the cover 2. Similar rectangular reinforcing grooves 30 are formed in the bottom wall 14 of the base 3. Each of these rectangular grooves 30 resists bending in four directions on the plane of the top and bottom walls 7 and 14.

Figure 7:
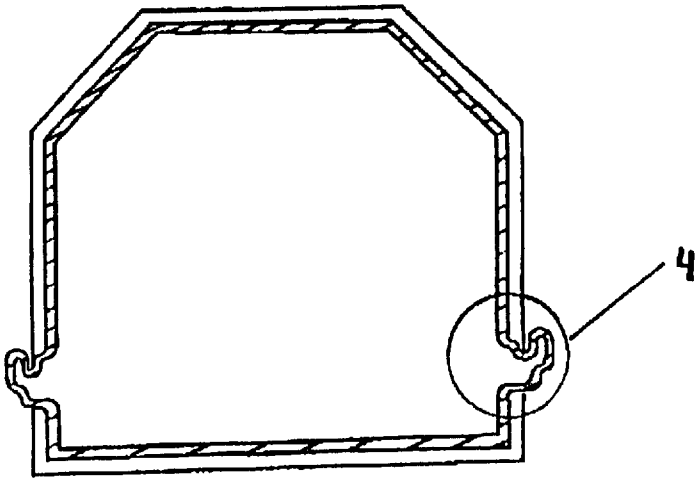
FIG. 7 is a cross-sectional view illustrating the sealing sections prior to separation.
Figure 6:
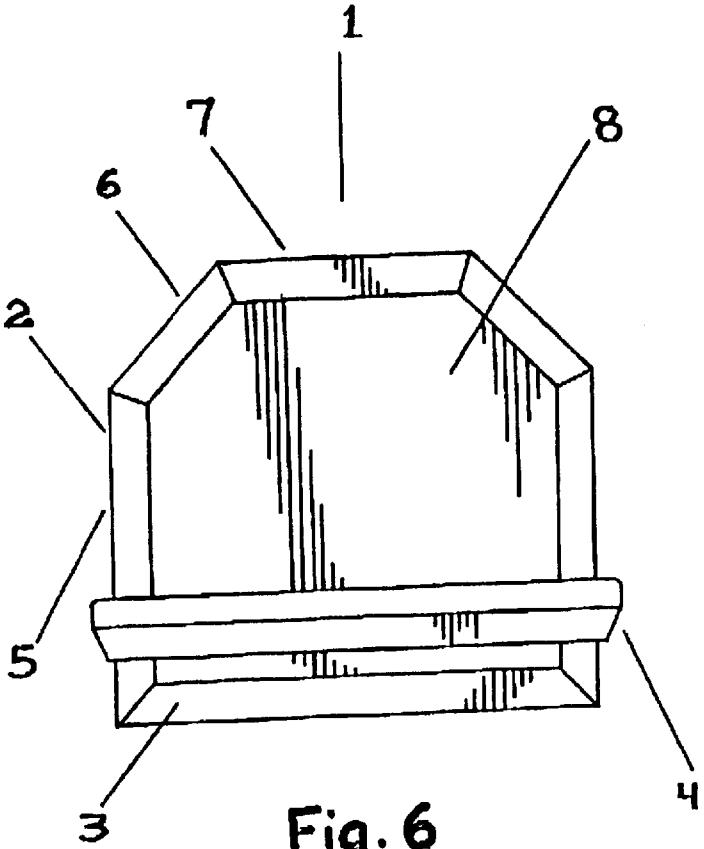
FIG. 6 is an end view of the burial vault.
Figure 9:
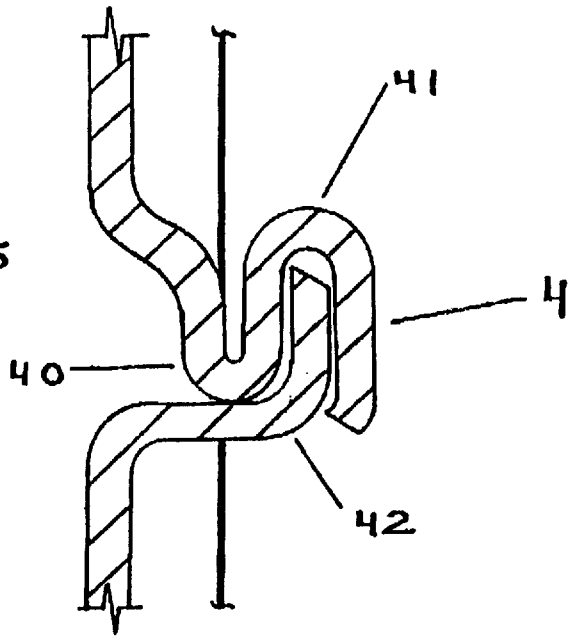
FIG. 9 is a close-up of be sealing sections after separation.
Figure 8:
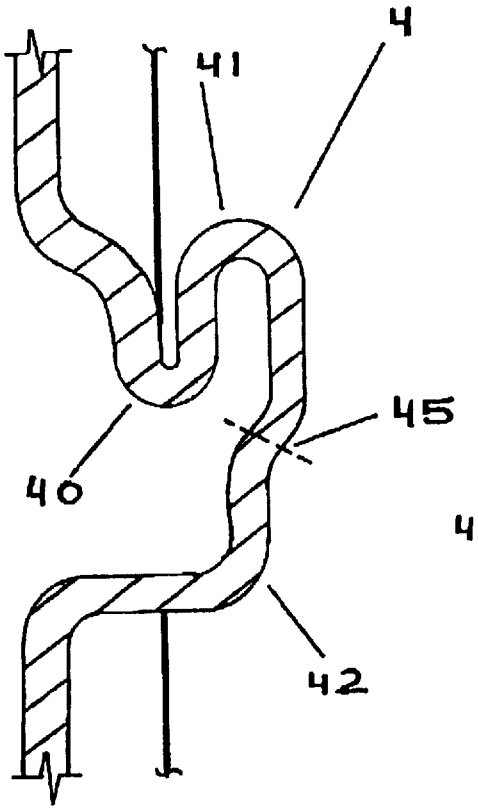
FIG. 8 is a close-up view of the cross-section of the sealing sections prior to separation.

The sealing section 4 is illustrated In FIGS. 7, 8 and 9. One part of the sealing section 4, circled in FIG. 7, is detailed in FIG. 8. The sealing section 4 shown in FIG. 8 is moulded as an integral section comprising a U-shaped portion 40, an inverted U-shaped portion 41 and a distorted L-shaped portion 42. After moulding, parts 41 and 42 are severed along cutting line 45 to separate the cover 2 from the base 3. The cover 2 and the base 3 may be rejoined, however, as shown in FIG. 9, with the lower leg of the L-shaped portion 42 becoming a sealing surface to receive the U-shaped portion 40 while the inverted U-shaped portion 41 receives the upper leg of the L-shaped portion 42 to resist lateral displacement of the cover 2 relative to the base 3. Thus a sealing joint may be formed about the periphery of the vault.

The walls of the vaults may be appropriately sized and slanted to permit stacking of a plurality of covers 2 or bases 3 within one another cover to reduce volume of the package during shipping and storage. Alternatively, where it is desirable to do so, the separation of the cover 2 and the base 3 may be delayed until shortly before the casket is inserted to preserve and to ensure the original quality of its hollow interior for the casket.

In the preferred embodiment the burial vault of this invention is 25" in height. This allows cemeteries to dig shallow graves for single or double depth burials. A burial generally has a minimum of 24" of soil coverage. The cost savings to cemeteries can be appreciated when the height of the burial vault of this invention is compared to typical cement or injection moulded vaults currently on the market and which are 32" to 36" in height (to allow for large inside ribbing on prior plastic vaults and thick walls in cement vaults), and requiring deeper graves for either single or double depth burials. Further the top surface of the burial vault of this invention has a width of 23" to allow for like burial vaults to be stacked for double depth burials without the top vault from tipping over when new burials take place beside an already existing burial site.

The description of the preferred embodiment is intended to be illustrative of the features of this invention and is not intended to exclude from the scope of this invention mechanical equivalents or colourful imitations or immaterial variations from the invention as described in the whole of the specification and claims.

The embodiments of the invention in which an exclusive property or privileges is claimed are defined as follows:

1. A hollow plastic burial vault comprising a base having a bottom wall, two side walls and two end walls and a cover having a top wall, two side walls and two end walls wherein said cover and base are moulded as an integral unit joined by a peripheral flange extending about the vault, said flange including a first sealing surface portion, a first joint portion, a second sealing surface portion and a second joint portion; said first sealing portion being formed to seat and seal against said second sealing surface and said first joint portion being formed to join releasably with said second joint portion when the flange is severed along its length to separate the cover and said first sealing surface and joint portions from the base and the second sealing surface and joint portions.

2. The burial vault of claim 1 in which the cover and the base each have a plurality of reinforcing grooves having sidewalls of a depth sufficient to strengthen the top, bottom, and side walls of the base and the cover against predetermined loading of the vault during burial.

3. The burial vault of claim 2 in which at least one of the cover and the base has one or more walls having grooves formed in one or more rectangles to reinforce said walls against bending under predetermined loading during burial.

4. A hollow plastic burial vault comprising:

a base having a bottom wall, two side walls, and two end walls;

a cover having a top wall, two side walls, and two end walls; and a peripheral flange extending about the vault between the cover and the base and including:
- a first sealing surface U-shaped portion;
- a first joint inverted U-shaped portion;
- a second joint upward extending portion; and
- a second horizontal sealing surface portion, said first sealing U-shaped portion being formed to seat and seal against said horizontal sealing surface portion, and said first joint inverted U-shaped portion being formed to receive in a releasable connection said second joint upward extending portion to restrict lateral movement when the flange is severed along its length to separate the cover and said first sealing U-shaped surface and inverted U-shaped joint portions from the base and the said upward extending joint portion and the second horizontal sealing surface portion.

5. A burial vault of claims 1, 2, 3, or 4, wherein the vault is 25" in height from the bottom wall of said base to the top wall of said cover.

6. A burial vault of claims 1, 2, 3, or 4, wherein the top wall of said cover of the vault has a width of 23".

7. A method of manufacturing a hollow plastic burial vault comprising a base having a bottom wall, two side walls, and two end walls, and a cover having a top wall, two side walls, and two end walls, comprising the steps of:

a) moulding said cover and base as an integral unit joined by a peripheral flange extending about the vault, said flange including a first sealing surface portion, a first joint portion, a second sealing surface portion, and a second joint portion; said first sealing portion being formed to seat and seal against said second sealing surface and said first joint portion being formed to join releasably with said second joint portion when the flange is severed along its length to separate, and b) severing the flange to separate the cover and said first sealing surface and joint portions from the base and the second sealing surface and joint portions.

* * * * *